US006514565B2

(12) United States Patent
Dearnaley et al.

(10) Patent No.: US 6,514,565 B2
(45) Date of Patent: Feb. 4, 2003

(54) METHOD FOR PRODUCING A LUBRICIOUS AMORPHOUS CARBON FILM

(75) Inventors: Geoffrey Dearnaley, San Antonio, TX (US); Mark Van Dyke, Fair Oaks Ranch, TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 09/827,562

(22) Filed: Apr. 6, 2001

(65) Prior Publication Data

US 2001/0049018 A1 Dec. 6, 2001

Related U.S. Application Data

(63) Continuation of application No. 09/342,542, filed on Jun. 29, 1999, now Pat. No. 6,410,144, which is a continuation-in-part of application No. 09/026,451, filed on Feb. 19, 1998, now Pat. No. 6,001,481, which is a continuation-in-part of application No. 08/662,728, filed on Jun. 10, 1996, now Pat. No. 5,863,621, which is a continuation-in-part of application No. 08/400,612, filed on Mar. 8, 1995, now abandoned.

(51) Int. Cl.[7] ..... C23C 16/26

(52) U.S. Cl. ..... 427/249.1; 427/249.7; 427/255.29

(58) Field of Search ..... 427/249.7, 255.29, 427/249.1

(56) References Cited

U.S. PATENT DOCUMENTS

| | | | | |
|---|---|---|---|---|
| 3,715,211 A | | 2/1973 | Quaintance | |
| 3,734,784 A | | 5/1973 | Bereday et al. | |
| 4,022,925 A | | 5/1977 | Reuter et al. | |
| 4,225,398 A | | 9/1980 | Hasegawa et al. | |
| 4,483,751 A | | 11/1984 | Murayama et al. | |
| 4,537,793 A | | 8/1985 | Kehrer et al. | |
| 4,660,297 A | | 4/1987 | Danielson | |
| 5,000,831 A | | 3/1991 | Osawa et al. | |
| 5,102,689 A | | 4/1992 | Bachmann et al. | |
| 5,116,592 A | | 5/1992 | Weinberg | |
| 5,230,929 A | | 7/1993 | Caporiccio et al. | |
| 5,238,705 A | | 8/1993 | Hayashi et al. | |
| 5,249,554 A | | 10/1993 | Tamor et al. | |
| 5,275,850 A | * | 1/1994 | Kitoh et al. | 427/130 |
| 5,279,866 A | | 1/1994 | Bourget et al. | |
| 5,391,407 A | | 2/1995 | Dearnaley | |
| 5,449,924 A | | 9/1995 | Hur et al. | |
| 5,501,745 A | | 3/1996 | Dearnaley | |
| 5,506,446 A | | 4/1996 | Hoffman et al. | |
| 5,512,330 A | | 4/1996 | Dearnaley | |
| 5,523,121 A | | 6/1996 | Anthony et al. | |
| 5,728,465 A | | 3/1998 | Dorfman et al. | |
| 5,740,941 A | | 4/1998 | Lemelson | |
| 5,786,038 A | * | 7/1998 | Conley et al. | 427/249.6 |
| 5,858,477 A | * | 1/1999 | Veerasamy et al. | 427/249.7 |
| 5,863,621 A | | 1/1999 | Dearnaley et al. | |
| 6,299,946 B1 | * | 10/2001 | Toyoguchi et al. | 427/130 |

FOREIGN PATENT DOCUMENTS

| | | |
|---|---|---|
| JP | 49-5822 | 2/1974 |

OTHER PUBLICATIONS

C.J. Bedell et al., "Diamond–like Carbon From the Ion–Beam Decomposition of Polyphenyl Ether", *Applications of Diamond Films & Related Materials*, 1991, pp. 833–838.

Malcolm W. Browne, "Diamond Coating May be Future of Tool Manufacture", *San Antonio Express–News*, Apr. 1, 1996 No page No.

G. Dearnaley, "Materials Science Aspects of Ion Beam Technology", *Surface Engineering*, 1991, vol. 7, No. 2, pp. 127–136.

Gerhard Herzberg, "III. Electronic Spectra and Electronic Structure of Polyatomic Molecules", *Molecular Spectra and Molecular Structure*, 1950, D. Van Nostrand Company, pp. 488–512.

Keith O. Legg, "Surface Engineering with Ion–Assisted Coatings", *Nuclear Instruments and Methods in Physics Research*, 1987, B24/25, pp. 565–567.

* cited by examiner

*Primary Examiner*—Bret Chen
(74) *Attorney, Agent, or Firm*—Paula D. Morris & Associates, P.C.

(57) ABSTRACT

An amorphous carbon film, preferably disposed on and substantially filling the pores in a porous anodized aluminum outer surface, wherein the amorphous carbon film comprises as an integral component an effective amount of a lubricity-increasing agent, preferably sulfur.

12 Claims, No Drawings

METHOD FOR PRODUCING A LUBRICIOUS AMORPHOUS CARBON FILM

The present application is a continuation of U.S. patent application Ser. No. 09/342,542, filed Jun. 29, 1999, now U.S. Pat. No. 6,410,144, currently pending; which is a continuation-in-part of U.S. patent application Ser. No. 09/026,451, filed Feb. 19, 1998, issued as U.S. Pat. No. 6,001,481; which was a continuation-in-part of U.S. patent application Ser. No. 08/662,728, filed Jun. 10, 1996, issued as U.S. Pat. No. 5,863,621; which was a continuation-in-part of U.S. patent application Ser. No. 08/400,612, filed Mar. 8, 1995, abandoned.

FIELD OF THE INVENTION

The present invention is directed to methods for increasing the lubricity of a film of amorphous carbon, to amorphous carbon films formed by such methods, and to anodized aluminum surfaces sealed with those films.

BACKGROUND OF THE INVENTION

Diamond-like carbon—or "amorphous carbon"—is known to have a low coefficient of friction. As a result, amorphous carbon commonly is used to coat a variety of materials which are exposed to friction and wear during use.

Aluminum is commonly used to manufacture many different articles, some of which are exposed to substantial friction and wear during use. Aluminum tends to resist corrosion because a substantially transparent "natural" oxide layer forms at the surface of aluminum upon exposure to air. The oxide layer prevents direct contact between the underlying aluminum and corrosive materials in the surrounding environment. Unfortunately, this "natural oxide" layer does not always have a uniform thickness. Because of this, natural oxides generally are removed from aluminum products, and the product then is "anodized," or controllably oxidized, to provide a protective oxide layer with better quality and substantially greater thickness.

Anodizing processes generally involve the use of a bath containing an electrolyte, such as sulfuric acid, oxalic acid, chromic acid, phosphoric acid, or combinations thereof, with or without certain addition agents. The aluminum workpiece generally is used as an anode and a component made of steel or other suitable material is used as a cathode. The anode and cathode are immersed in the electrolyte solution, and a direct or alternating current is passed through the electrolyte.

Although anodizing, itself, imparts satisfactory corrosion resistance to aluminum components, anodizing also suffers from several disadvantages. One disadvantage is the porosity of the oxide formed at the surface of the aluminum component. A typical anodizing treatment results in a porous polygonal cellular microstructure superimposed on a thin (less than 100 nm) "barrier" layer. The diameter of the pores in the microstructure can be as small as 10 nm. The cell dimension can be as small as about 30 nm.

The pores formed at the surface of anodized aluminum are undesirable because they tend to serve as corrosion sites, which give rise to deep pits. Deep pits in the anodized surface often result in "blooms" or white spots on the surface of the aluminum. In order to protect anodized aluminum from corrosion, especially in halide or salt-containing environments, the pores of the aluminum oxide customarily are sealed by immersion in a hot solution containing hexavalent chromium. A complex chemical reaction occurs, forming a solid compound of chromium, aluminum, oxygen, and some hydrogen within the pores of the anodized surface. This solid compound seals the pores against penetration by corrosive agents.

Unfortunately, hexavalent chromium solutions are toxic. The use and disposal of hexavalent chromium solutions therefore creates environmental concerns. Environmental concerns, and their associated costs, have created an urgent need for alternative sealing processes that are free from such hazards. The need for alternative sealing processes is intensified because the process used to form a chromate sealant does not purge the pores of the aluminum before or while the chromate sealant is formed. As a result, at least some gas remains in many of the pores, serving as corrosion sites.

Some have attempted to develop alternate sealing processes using other chemical solutions. Until recently, these alternative chemical solutions have not been entirely successful. The-present invention provides an effective method for sealing anodized aluminum surfaces with a sealant which is not only non-toxic, but even more lubricious than previous amorphous carbon coatings.

SUMMARY OF THE INVENTION

The present invention provides a film of amorphous carbon comprising as an integral component an effective amount of a lubricity-increasing agent. In a preferred embodiment, the film is disposed on and substantially fills the pores in an anodized aluminum surface.

DETAILED DESCRIPTION OF THE INVENTION

The present invention is directed to a highly lubricious form of amorphous carbon, to precursor materials for its formation, to anodized "aluminum" surfaces bearing this amorphous carbon as a sealant, and to methods of forming the highly lubricious amorphous carbon.

As used herein, the terms "diamond-like" carbon and "amorphous" carbon refer to a carbonaceous material composed of a mixture of "$sp^2$" and "$sp^3$" bonded carbon. "$Sp^2$" bonded carbon refers to double bonded carbon commonly associated with graphite. "$Sp^3$" bonded carbon refers to single bonded carbon commonly associated with diamond. Unlike diamond, amorphous or "diamond-like" carbon does not possess a highly ordered crystalline structure. Amorphous carbon generally takes the form of small nanometer sized (or larger) islands of graphite dispersed within an amorphous matrix of $sp^3$ bonded carbon.

Depending upon the method of deposition, the amorphous carbon may be essentially 100% carbon or may have a sizeable amount (up to 50 atomic %) of C—H bonded hydrogen. The term "diamond-like" often is used to describe the bulk mechanical properties of the amorphous carbon, specifically its hardness (anywhere from 10–40% of the hardness of crystalline diamond) and its low coefficient of friction under dry sliding conditions (frequently<0. 1). Amorphous carbon does not usually exist in bulk form, but is deposited as a coating or film by such methods as ion beam assisted deposition, direct ion beam deposition, magnetron sputtering, ion sputtering, chemical vapor deposition, plasma enhanced chemical vapor deposition, cathodic arc deposition, and pulsed laser deposition.

Diffusion pump fluids commonly are used as precursor materials for the formation of amorphous carbon. Diffusion pump fluids have a low vapor pressure and can be vaporized stably at room temperature. Examples of diffusion pump fluids which may be modified for use as precursor materials in the present invention include, but are not necessarily limited to: polyphenyl ether; elcosyl naphthalene; i-diamyl phthalate; i-diamyl sebacate; chlorinated hydrocarbons; n-dibutyl phthalate; n-dibutyl sebacate; 2-ethyl hexyl sebacate; 2-ethyl hexyl phthalate; di-2-ethyl-hexyl sebacate; tri-m-cresyl phosphate; tri-p-cresyl phosphate;0 dibenzyl sebacate. Other suitable precursor materials are the vacuum-distilled hydrocarbon mineral oils manufactured by Shell Oil Company under the trademark APIEZON, and siloxanes, such as polydimethyl siloxane, pentaphenyl-trimethyl siloxane, and other silicon containing diffusion pump fluids, preferably pentaphenyl-trimethyl siloxane.

Any of the foregoing materials may be modified to incorporate a lubricity-increasing agent and to form the highly lubricious precursor material of the present invention. The resulting precursor material preferably should have a low vapor pressure and be vaporized stably at room temperature.

A preferred lubricity-increasing agent for incorporation into the precursor material is sulfur. Theoretically, fluorine could be used as a lubricity-increasing agent; however precautions would have to be taken to prevent substantial release of the fluorine in the form of HF during processing. As used herein, the phrases "increase the lubricity," "increase in lubricity" and the like shall mean a decrease in the coefficient of friction of an amorphous carbon sealant from about 0.1 to about 0.03.

In a preferred embodiment, from about 27 wt % to about 31 wt % sulfur is incorporated into a siloxane to form a mercapto-siloxane precursor material with a molecular weight of from about 1000 to about 5000 g/mole, preferably about 3000 g/mole. In order to synthesize suitable mercapto-siloxanes, monomeric starting materials comprising silicon and sulfur are polymerized, or mercapto-functional oligocyclic siloxanes are subjected to ring-opening polymerization techniques.

Suitable monomeric starting materials include, but are not necessarily limited to mercapto-functional silane monomers having four substituents. Suitable first substituents for the mercapto-functional silane monomers include, but are not necessarily limited to sulfur-containing organic groups, including but not limited to mercapto-alkyl groups. Suitable mercapto-alkyl groups could be larger, but preferably have from about 1 to about 6 carbon atoms, most preferably from about 1 to about 3 carbon atoms. For example, suitable first substituents include, but are not necessarily limited to mercaptomethyl or 3-mercaptopropyl groups.

Suitable second substituents for the mercapto-functional silane monomers are groups which are useful as sites for condensation polymerization. Such groups include, but are not necessarily limited to hydroxy groups and alkoxy groups, preferably alkoxy groups having from about 1 to about 3 carbon atoms.

Suitable fourth groups for the mercapto-functional silane monomers are groups which are sufficiently small and substantially inert to avoid "diluting" the sulfur present. Suitable fourth groups include, but are not necessarily limited to hydrogen, aromatic groups, or alkyl groups preferably having from about 1 to about 3 carbon atoms, most preferably methyl groups, and other substantially inert substituents.

As an example, monomeric mercaptomethymethyldiethoxysilane may be polymerized to poly (mercaptomethylmethylsiloxane) using one of several potential catalyst systems. Suitable catalyst systems include, but are not necessarily limited to metal hydroxides and transition metal catalysts. In an exemplary procedure, 20 g of mercaptomethylmethyldiethoxysilane is placed in a clean 250 mL round bottom flask containing a magnetic stir bar. 100 mL of water saturated toluene is added, the flask is fitted with a cold water condenser, and the solution is stirred using a magnetic stir plate while gently heating to 60° C. Approximately 7 grams of dibutyl tin dilaurate catalyst is added and heating and stirring is continued. The progression of the reaction is monitored via gel permeation chromatography until the desired molecular weight is obtained. Once this point is reached, the reaction is cooled and added to an excess of cold methanol. The polymer is removed as a separate layer.

In order to perform ring-opening polymerization, mercapto-functional oligocyclic siloxanes are polymerized. Suitable mercapto-functional oligocyclic siloxanes include, but are not necessarily limited to (mercaptoalkyl)alkyl siloxanes comprising alkyl groups having from about 1 to about 3 carbon atoms, such as (mercaptopropyl)methylsiloxane. The cyclic precursor is subjected to a ring-opening agent. Suitable ring-opening agents include, but are not necessarily limited to metal hydroxides and metal alkyl compounds, such as n-butyl lithium. In an exemplary procedure, 20 g of tetra (metcaptomethyl)tetramethylcyclotetrasiloxane is placed in a clean, dry 250 mL round bottom flask containing a magnetic stir bar. 20 mL of dry diglyme is added as a promoter and the mixture is heated to 100° C. while stirring. An amount of semiconductor-grade sodium hydroxide is added to achieve the desired molecular weight, bearing in mind the inverse relationship between molecular weight and catalyst concentration. The progression of the reaction is monitored via gel permeation chromatography until the desired molecular weight is obtained. Once this point is reached, the reaction is cooled and added to an excess of cold methanol. The polymer is removed as a separate layer.

If it is desired to use flourine-containing monomers, suitable monomers for use in the first procedure described above would be trifluoropropylmethyldichlorosilane (without using a tin catalyst) and tetra(trifluoropropyl) tetramethyl cyclotetrasiloxane in the second, ring-opening polymerization.

In a preferred embodiment, the precursor materials are used to form a film of highly lubricious amorphous carbon on the surface of anodized aluminum. As used herein, the word "aluminum" is defined to mean aluminum and alloys thereof that are amenable to anodization. The flowable precursor material is applied to the porous anodized aluminum surface in a vacuum, as explained more fully below. The application of the precursor material in a vacuum causes the precursor material to penetrate into the pores in the surface of the anodized aluminum, pushing out any remaining gas in the pores and substantially filling the pores. The precursor material then is converted into a highly lubricious form of amorphous carbon by application of energy, preferably in the form of an ion beam. The result is an adherent interface between the anodized aluminum surface and the a lubricious amorphous carbon sealant. The resulting sealant is chemically inert and impermeable, has an extremely low coefficient of friction, and forms a mechanically strong surface that will withstand exposure to high temperatures and friction.

Because the amorphous carbonaceous sealant is relatively hydrophobic, it is important to treat the anodized aluminum surface to remove any adsorbed water molecules before applying the sealant. It was determined that water molecules have a much higher coefficient of absorption for UV light with a shorter wavelength, in the region of 120–150 nm, than for the longer wavelength UV light produced by conventional UV lamps. Exposure of adsorbed water molecules to low intensity UV light was found to result in more rapid, and more effective desorption of water molecules from the anodized aluminum surface.

Short wavelength UV radiation can be obtained using unconventional UV lamps, such as deuterium discharge lamps. Deuterium discharge lamps generate UV radiation having wavelengths down to 120 nm. These lower wavelength UV lamps can be modified, using special windows formed of substances such as magnesium fluoride, to transmit radiation down to wavelengths of about 110 nm.

To treat an anodized aluminum component, the component preferably should placed in a vacuum chamber provided with: (a) a source of short wavelength low intensity UV radiation; (b) a reservoir for vaporizing the precursor material and directing the vapor onto the component; and (c) an ion gun or other suitable apparatus for accelerating ions and bombarding the component with an energetic beam of ions.

The pressure in the vacuum chamber should be pumped down to at least about $10^{-6}$ torr. In a preferred embodiment, a 150 watt UV lamp is used to produce UV radiation in the range of about 110–180 nm, preferably between about 120–150 nm. The surface of the anodized aluminum should be exposed to a flux of this low intensity UV radiation for a time sufficient to remove adsorbed water molecules from the anodized surface. Using a 150 watt lamp and 120–150 nm UV light, this should take about 20 minutes.

The precursor material is placed in a reservoir and exposed to a suitable form and quantity of energy to vaporize the precursor material. Any of a number of energy sources and types may be used to vaporize the precursor material. Suitable energy sources include an ion beam, electrical resistance heating, electromagnetic energy, radiation, quartz halogen lamps, and other suitable sources. In a preferred embodiment, the vacuum chamber reservoir is supplied with electrical resistance heating.

After the precursor material is placed in a suitable reservoir for vaporization, the precursor material is heated to an appropriate temperature for vaporization. For mercaptosiloxanes having a molecular weight of about 3000 g/mole, a preferred vaporization temperature is from about 150° C. to about 200° C., preferably about 175° C. The resulting vapor flux is directed toward the surface to be sealed, for example, through an aperture or nozzle, until a preferred coating thickness of between about 1–5$\mu$ is achieved. The thickness of the coating may be monitored by standard methods, e.g., using the frequency change of a quartz crystal oscillator.

In order to decompose the precursor material to form a film of amorphous carbon, the component is subjected to sufficient energy to ionize the constituent molecules in the precursor material, and to rupture the bonds between hydrogen and other atoms, such as carbon, silicon, sulfur, etc., thereby releasing the hydrogen into the surrounding vacuum to be pumped away. In a preferred embodiment, the component is bombarded with an energetic beam of ions, preferably substantially simultaneously with vapor deposition of the precursor material. The bombardment may be either in a continuous or interrupted fashion. The ions preferably are ionized gaseous species such as hydrogen, helium, neon, nitrogen, argon, methane, carbon monoxide, or other relatively low mass gaseous elements or compounds. The bombardment energy required to rupture the necessary bonds ranges from about 1 keV to about 1 MeV, preferably from about 20 keV to about 100 keV.

The "ion arrival ratio" is controlled in relation to the rate of arrival of the precursor molecules. The "ion arrival ratio" is defined as the ratio of each arriving ion to the number of precursor molecules present at the surface of the component. The ion arrival ratio preferably should be at least 1 ion for every molecule of precursor. This process should require about one ion for every 100 atoms in the final product coating; however, the required ion-to-atom ratio will vary according to the mass and energy of the ion species. Typically, 100 eV must be deposited for each carbon atom in the coating. Persons of ordinary skill in the art can relate the ion beam current per unit area to the arrival rate of precursor molecules.

The ion bombardment is continued until the precursor molecules are ionized and converted into an inert, solid, impermeable, mechanically strong, and highly lubricious material. The amount of time required to achieve this conversion varies with the intensity of the ion beam. At an ion-to-atom ratio of 1 to 100 and an energy of about 20 keV to about 100 keV, about 30 minutes of ion bombardment should be sufficient.

Persons of skill in the art will appreciate that many modifications may be made to the embodiments described herein without departing from the spirit of the present invention. Accordingly, the embodiments described herein are illustrative only and are not intended to limit the scope of the present invention.

We claim:

1. A method for producing a lubricious amorphous carbon film comprising providing as a integral component of said film a dispersion of a quantity of a lubricity-increasing agent comprising sulfur, said quantity of said lubricity-increasing agent being effective to produce a lubricious surface having a first coefficient of friction that is less than a second coefficient of friction of an amorphous carbon surface absent said lubricity increasing agent.

2. A method for producing a lubricious amorphous carbon film comprising providing as a integral component of said film a dispersion of a quantity of a lubricity-increasing agent comprising sulfur, said dispersion and said quantity being effective to produce a lubricious surface having a coefficient of friction of 0.1 or less.

3. A method for producing a lubricious amorphous carbon film comprising providing as a integral component of said film a dispersion of a quantity of a lubricity-increasing agent comprising sulfur, said dispersion and said quantity being effective to produce a lubricious surface having a coefficient of friction of less than 0. 1.

4. A method for producing a lubricious amorphous carbon film comprising providing as a integral component of said film a dispersion of a quantity of a lubricity-increasing agent comprising sulfur, said dispersion and said quantity being effective to produce a lubricious surface having a coefficient of friction of less than 0.03.

5. A method for producing a lubricious amorphous carbon film comprising providing as a integral component of said film a dispersion of a quantity of sulfur effective to produce a lubricous surface having a first coefficient of friction that is less than a second coefficient of friction of an amorphous carbon surface absent said lubricity increasing agent.

6. The method of claim 5 wherein said quantity of lubricity increasing agent is from about 27 wt % to about 31 wt %.

7. A method for producing a lubricious amorphous carbon firm comprising providing as a integral component of said film a dispersion of a quantity of sulfur effective to produce a coefficient of friction at said surface of 0.1 or less.

8. The method of claim 7 wherein said quantity of lubricity increasing agent is from about 27 wt % to about 31 wt %.

9. A method for producing a lubricious amorphous carbon film comprising providing as a integral component of said film a dispersion of a quantity of sulfur effective to produce a coefficient of friction at said surface of less than 0.1.

10. The method of claim 9 wherein said quantity of lubricity increasing agent is from about 27 wt % to about 31 wt %.

11. A method for producing a lubricious amorphous carbon film comprising providing as a integral component of said film a dispersion of a quantity of sulfur effective to produce a coefficient of friction at said surface of 0.03 or less.

12. The method of claim 11 wherein said quantity of lubricity increasing agent is from about 27 wt % to about 31 wt %.

* * * * *